United States Patent [19]

Flynn

[11] 4,337,973

[45] Jul. 6, 1982

[54] DOOR LOCK

[76] Inventor: Jean L. Flynn, 1401 Saratoga Blvd., DeLand, Fla. 32720

[21] Appl. No.: 95,547

[22] Filed: Nov. 19, 1979

[51] Int. Cl.[3] ..... E05C 17/54

[52] U.S. Cl. ..... 292/290; 292/298

[58] Field of Search ..... 292/289–298

[56] References Cited

U.S. PATENT DOCUMENTS

| | | | |
|---|---|---|---|
| 312,426 | 2/1885 | Bullock | 292/291 |
| 897,206 | 8/1908 | Hembree | 292/290 |
| 1,066,770 | 7/1913 | Wanz et al. | 292/296 |
| 1,512,142 | 10/1924 | Sessions | 292/247 |
| 2,828,990 | 4/1958 | Brown | 292/218 X |

*Primary Examiner*—Richard E. Moore

*Attorney, Agent, or Firm*—William M. Hobby, III

[57] ABSTRACT

A portable door locking apparatus has a body having two end portions and a retaining hook member movably attached to the body between the end portions. The retaining hook member has a hooking end portion shaped to engage an opening in a door jamb striker plate and a pair of spaced arms extending between the hooking end portion and the body, and being of a length to extend from the opening in a door jamb striker plate to one edge of a striker plate. The retaining hook member has a folded position with spaced arms parallel and adjacent to the body and a connecting position with the spaced arms extending from one end portion of the body to allow the door to be closed with the retainer hook hooked to the striker plate and a locking position with the retainer hook arms extending from the body in a generally perpendicular direction so that the hook can be connected to the door striker plate and the body turned to extend over a portion of the jamb and door whereby a portable door lock may be quickly connected to a door.

8 Claims, 9 Drawing Figures

DOOR LOCK

BACKGROUND OF THE INVENTION

The present invention relates to door locks, and especially to a portable door locking member for attaching to conventional swinging doors having a latch bolt which catches in an opening in the jamb through a striker plate attached to the door jamb.

In the past, a wide variety of door locks have been provided for locking doors. Typically, these form a part of the door hardware in which the lock is incorporated into the door knobs, or in a separate bolt. The present invention, on the other hand, is adapted to be used with doors having only passage type hardware, as well as those having other locks to prevent entry through the door with a key or through doors not having locking means. The present door lock is advantageously combined with a key chain so as to be handy whenever the owner stops at a motel or hotel, or while visiting others, as well as in his own home.

SUMMARY OF THE INVENTION

A portable door locking apparatus has a body having at least two end portions and a retaining hook member movably attached to the body member. The retaining hook has a hooking end portion shaped to engage an opening in a door jamb striker plate and a pair of spaced arms connecting the hooking end portion to the body member. The spaced arms are of a length to extend from the opening in a door jamb to one edge of a striker plate. The retaining hook member has a folded position with the spaced amrs generally parallel and adjacent to the body member and a connecting position with the spaced arms extending from one portion of the body member to allow the door to be closed with the retaining hook member hooked to a striker plate and a locking position with the retainer hook member extending from the body member in a generally perpendicular direction so that the hook can be connected to the door striker plate with the body extending over a portion of the jamb and door. The body has a curved edge on one end to guide the door during closing, and a notch on either side having an aperture extending thereinto for attacing each arm to one side of the body so that the notches in the body form a catch for holding the retaining hook member arms in its locking position. The body also has a key ring attached thereto through an aperture in the body. One embodiment has the retaining hook arm supported in a sliding track which is positioned in its locking position with a pair of notches in the sides of the body.

BRIEF DESCRIPTION OF THE DRAWINGS

Other objects, features and advantages of the present invention will be apparent from the written description and the drawing, in which.

DESCRIPTION OF THE PREFERRED EMBODIMENT

Figure 1:
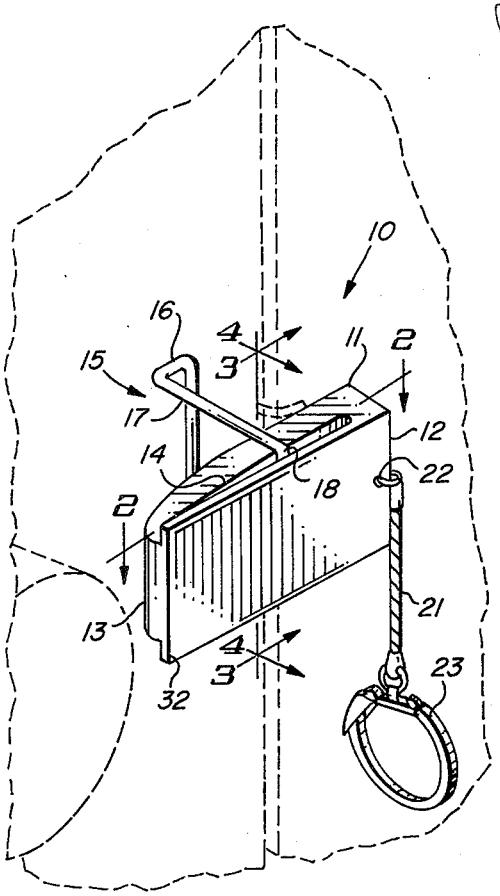
FIG. 1 is a perspective view of a preferred embodiment of the present invention positioned adjacent to a door.

Referring to FIGS. 1 through 5 of the drawings, a portable door lock 10 has a one piece metal body 11 having a blunt end 12 and a curved end 13 and a slide track 14. A retaining hook member 15 which is formed of steel rod stock has a hooking end portion 16, a pair of arms 17 and a fastening end portion 18. The retaining hook member 15 is more clearly seen in FIG. 5, which is formed of continuous steel rod having the fastening member 18 spring loaded like a spring clip by the arms 17 connected to the hooking portion 16. The fastening portion 18 rides in the slide track 14 and in its locking position is generally perpendicular to the body 11. It will snap into a pair of notches 20 to hold it in its locking position. A key chain 21 is connected to an aperture 22 in the body 11 and in turn is connected to a key ring 23. Thus, the locking device 10 may be utilized as a key ring so as to always have the locking device during travel.

Figure 2:
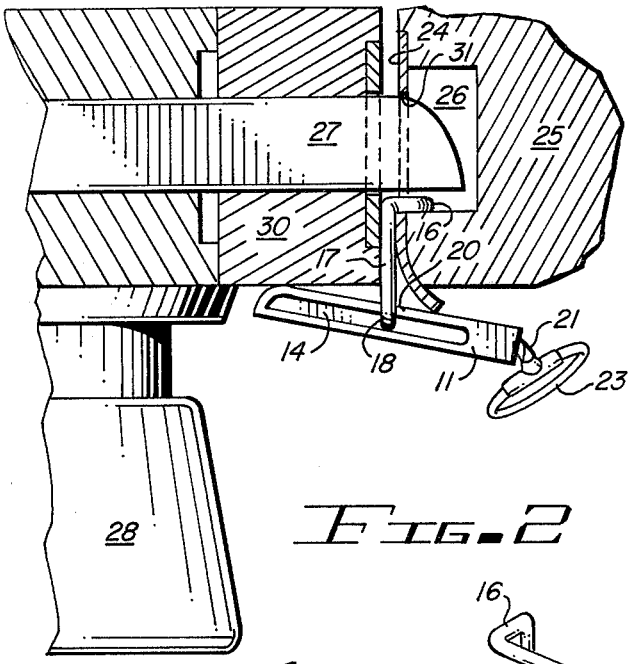
FIG. 2 is a sectional view taken through a door and jamb having the door lock attached thereto.
Figure 3:
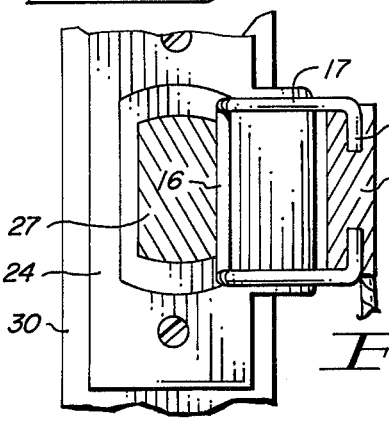
FIG. 3 is a sectional view taken along the line 3—3 of FIG. 1.
Figure 5:
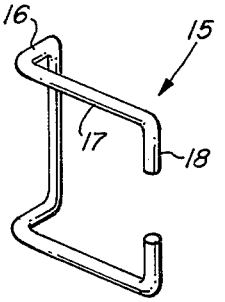
FIG. 5 is a perspective view of the retaining hook.
Figure 4:
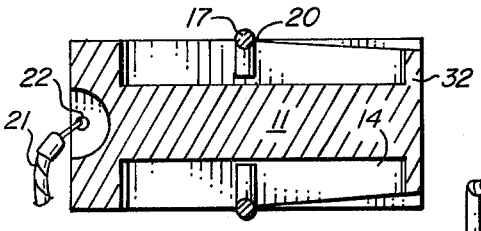
FIG. 4 is a sectional view taken along the line 4—4 of FIG. 1.
Figure 8:
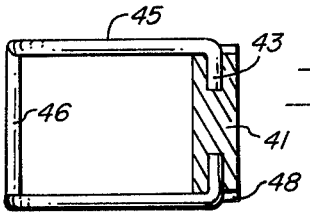
FIG. 8 is a sectional view taken on the line 8—8 of FIG. 7.

The device is used by aligning the hooking member 15 in a straight line with the body 11 with the hooking portion 16 inserted through a striker plate 24 attached to a door jamb 25. A cut-out 26 is made in the jamb 25 to allow the door hardware latch bolt 27 to slide through the striker plate 24. The latch bolt is operatively connected to the door knob 28 through the end of the door 30. The door is closed with the hooking member 16 hooked through the opening 31 of the striker plate 24 and the body extending straight out from the side of the striker plate 24. Once the door is closed and the bolt 27 is in place through the striker plate 24 into the opening 26 in the jamb 25, the body 11 is twisted to a generally perpendicular position and the fastening portion 18 of the retaining hook member 15 can be slid along the track 14 until it catches in a pair of notches 20, as illustrated in FIG. 2. Leaving the locking member in a locking position, as shown in FIG. 1, prevents the opening of the door 30 from the outside of the door. Sliding the latch bolt 27 back and pushing on the door merely pushes against the body 11 held by the hooking member 15 hooking portion 16 extending through the striker plate as shown in a sectional view in FIG. 3. When the locking device is not in use, the retaining hook 15 can be snapped out of the notches 20 and the fastening portion 18 slid in the track 14 toward the end 12 of the body 11 and rotated until the arms 17 stop against ledges 32 with the hooking portion 16 wrapped around the curved end portion 11 for a convenient, compact looking key ring support.

Figure 6:
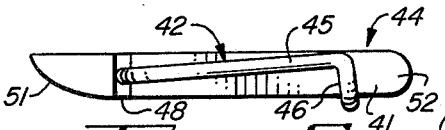
FIG. 6 is a side elevation of a second embodiment of a door lock in accordance with the present invention.
Figure 7:
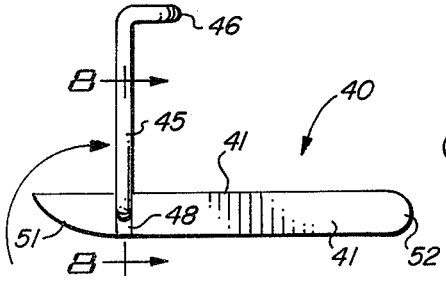
FIG. 7 is a side elevation of the door lock of FIG. 6 in its locking position.
Figure 9:
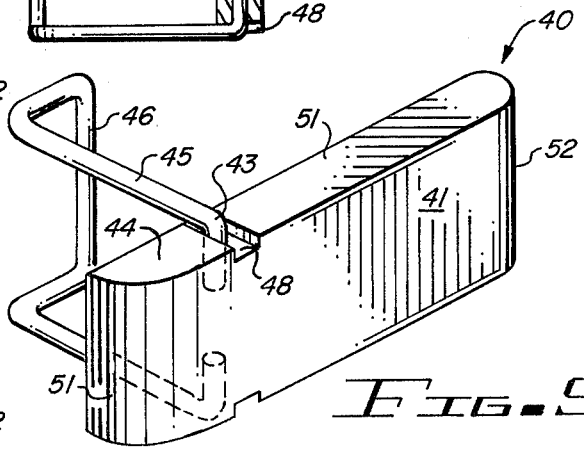
FIG. 9 is a perspective view of the embodiment of FIGS. 6 through 8.

FIGS. 6 through 9 show an alternate embodiment in which a locking member 40 has a body 41 and a retaining hook member 42 fastened with fastening members 43 into apertures 44 on each side of the body 41. The fastening members 43 are connected to a pair of arms 45 and hook portion 46 in the same manner as in the embodiment of FIGS. 1 through 5. This embodiment, however, does not have a sliding track so that the hook retaining member 47 rotates until reaching a pair of notches 48 on either side 50 of the body 41 where it snaps into the notches 48 to lock the retainer hook 47 into a locking position generally perpendicular to the body 41. This embodiment, similar to the one shown in FIGS. 1 through 5, has a curved end portion 51 and a second end portion 52 which may be flat or curved. The one sided curved end portion 51 conveniently allows the door to slide past the body 41 when the locking member is being attached to a door. The rotating retaining hook member 42 can rotate into a folded position as shown in FIG. 6 when not in use, allowing a curved hook portion 46 to conveniently fit over the body 41 as shown in FIG. 6, and can be easily swung all of the way around to the locked position, as shown in FIGS. 7 and 9, where the spring loaded arms 46 are locked into the notch 48. The rotating retaining hook member 42 can also be swung parallel to and extending out from the pointed end 51 during the insertion into a door jamb for closing the door for attaching the locking member 40. Once the door is closed with the hooking member 46 extending through the striker plate and into the jamb, the body 40 is merely rotated to place in a locking position with the retaining hook 43 snapped into the notches 48. This embodiment can also be provided with a keychain 53 attached to an aperture 54.

The present invention is made of a high grade of stainless steel, but it should be clear that other metals can be utilized without departing from the spirit and scope of the invention. Accordingly, the present invention is not to be construed as limited to the forms shown, which are to be considered illustrative rather than restrictive.

I claim:

1. A portable door lock comprising in combination:

a body member having at least two end portions and an aperture on each of two edges thereof;

a retaining hook member movably attached to said body member for movement thereon and having a hooking end portion shaped to engage an opening in a door jamb striker plate and a pair of spaced arms extending from said hooking end portion to said body member, said spaced arms being of a length to extend from the opening in a door jamb striker plate to one edge of the striker plate and said retaining hook member arms having a pair of spring loaded protrusions disposed in said apertures of said body member; and said retaining hook member having a folded position with said spaced arms generally parallel and adjacent to said body member, and a connecting position with said spaced arms extending from one end portion of said body member to allow a door to be closed with said retaining hook member hooked to a striker plate opening and a locking position with said retainer hook member arms extending from said body member in a generally perpendicular direction, whereby said hook can be connected to a door striker plate opening and said body extended over a portion of the edge of a door and door jamb for locking the door against entry.

2. A portable door lock in accordance with claim 1 in which said apertures in said body member each includes a sliding track in which said pair of spring loaded protrusions on said retaining hook member is slidable.

3. The portable door lock in accordance with claim 2, in which said body member has a notched portion on the edge of said body member along said sliding track for said spring loading arms to catch in for positioning said retaining hook member in its locking position.

4. The apparatus in accordance with claim 1, in which said body member has at least one end portion curved to ease the closing of a door when said retaining hook member is in a connecting position.

5. The apparatus in accordance with claim 1, in which said body member has a pair of notches formed thereon connecting with said apertures on said edges thereof for snapping said retaining hook member spaced arms in a predetermined locking position.

6. The apparatus in accordance with claim 5, in which said body member has one end portion curved for allowing the closing of a door when said portable door lock is in a connecting position.

7. The apparatus in accordance with claim 2 or 5 in which said retaining hook member is formed of one continuous steel rod and said hook member is formed to fit over a portion of said body member when in its folded position, said pair of spaced arms providing said spring loading.

8. The apparatus in accordance with claim 7, in which said body member has an aperture therethrough and a key chain attached thereto.

* * * * *